US010386053B2

(12) United States Patent
Lou et al.

(10) Patent No.: US 10,386,053 B2
(45) Date of Patent: Aug. 20, 2019

(54) HEATSINK AND LUMINAIRE

(71) Applicant: SIGNIFY HOLDING B.V., Eindhoven (NL)

(72) Inventors: Qun Lou, Shanghai (CN); Thijmen Galekop, Hilversum (NL); Lei Sui, Shanghai (CN); Huaizhou Liao, Shanghai (CN); Xingpeng Yang, Shanghai (CN); Shan Wang, Shanghai (CN); Zhen Yi Zheng, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/062,949

(22) PCT Filed: Dec. 9, 2016

(86) PCT No.: PCT/EP2016/080385
§ 371 (c)(1),
(2) Date: Jun. 15, 2018

(87) PCT Pub. No.: WO2017/108446
PCT Pub. Date: Jun. 29, 2017

(65) Prior Publication Data

US 2018/0372309 A1 Dec. 27, 2018

(30) Foreign Application Priority Data

Jan. 25, 2016 (EP) ..... 16152612

(51) Int. Cl.
*F21V 29/00* (2015.01)
*F21V 23/04* (2006.01)
(Continued)

(52) U.S. Cl.
CPC ..... *F21V 23/045* (2013.01); *F21S 8/06* (2013.01); *F21V 23/0442* (2013.01);
(Continued)

(58) Field of Classification Search
CPC ..... F21S 8/00; F21S 8/04; F21V 23/0442; F21V 23/045; F21V 23/0464;
(Continued)

(56) References Cited

U.S. PATENT DOCUMENTS 6,517,222 B1 2/2003 Orlov
8,362,509 B2 1/2013 Pickard et al.
(Continued)

FOREIGN PATENT DOCUMENTS

CN 201487718 U 5/2010
CN 201606852 U 10/2010
(Continued)

*Primary Examiner* — Jason M Han

(57) ABSTRACT

Disclosed is a luminaire (100) comprising: a heatsink (10) comprising a rim (20) 5 having a first rim section (21), a second rim section (22) and an intermediate rim section (23) in between the first rim section and the second rim section; a first heatsink region comprising a mounting region (40) and a plurality of first fins (31, 32) extending from the mounting region to at least one of the first rim section and the second rim section; and a second heatsink region comprising a plurality of second fins (33) looping from the 10 intermediate rim section; a light module (110) mounted in the mounting region (40) and thermally coupled to the first heatsink region, the light module comprising at least one light engine (120) and a controller (140) for the at least one light engine; and a sensor (50) mounted on the second heatsink region, the sensor being communicatively coupled to the controller, the controller being adapted to control the at least one light engine in 15 response to a sensor signal from the sensor.

14 Claims, 9 Drawing Sheets

(51) Int. Cl.

| | |
|---|---|
| ***F21S 8/06*** | (2006.01) |
| ***F21V 29/508*** | (2015.01) |
| ***F21V 29/74*** | (2015.01) |
| ***F21V 29/83*** | (2015.01) |
| *F21V 29/76* | (2015.01) |
| *F21V 29/77* | (2015.01) |
| *F21Y 105/10* | (2016.01) |
| *F21Y 115/10* | (2016.01) |
| *H05B 33/08* | (2006.01) |

(52) U.S. Cl.
CPC ..... *F21V 29/508* (2015.01); *F21V 29/74* (2015.01); *F21V 29/83* (2015.01); *F21V 23/0464* (2013.01); *F21V 29/763* (2015.01); *F21V 29/773* (2015.01); *F21Y 2105/10* (2016.08); *F21Y 2115/10* (2016.08); *H05B 33/0845* (2013.01)

(58) Field of Classification Search
CPC ..... F21V 29/508; F21V 29/74; F21V 29/745; F21V 29/75; F21V 29/76; F21V 29/763; F21V 29/77; F21V 29/773; F21V 29/83
USPC ..... 362/218, 249.02, 294, 373
See application file for complete search history.

(56) References Cited

U.S. PATENT DOCUMENTS

| | | | |
|---|---|---|---|
| 2013/0322079 | A1 | 12/2013 | Guercio et al. |
| 2014/0268800 | A1 | 9/2014 | Castillo et al. |
| 2015/0036361 | A1 | 2/2015 | Watanabe et al. |
| 2015/0138784 | A1 | 5/2015 | Pratt et al. |

FOREIGN PATENT DOCUMENTS

| | | | |
|---|---|---|---|
| DE | 29612602 | U1 | 1/1997 |
| DE | 102004044024 | A1 | 3/2006 |
| EP | 2118560 | A1 | 11/2009 |
| EP | 2470829 | A2 | 7/2012 |
| FR | 2587089 | A1 | 3/1987 |
| JP | 2004158400 | A | 6/2004 |
| WO | 2011079643 | A1 | 7/2011 |
| WO | 2011100449 | A1 | 8/2011 |

100

100

100

100

HEATSINK AND LUMINAIRE

CROSS-REFERENCE TO PRIOR APPLICATIONS

This application is the U.S. National Phase application under 35 U.S.C. § 371 of International Application No. PCT/EP2016/080385, filed on Dec. 9, 2016 which claims the benefit of Chinese Patent Application No. PCT/CN2015/098061, filed on Dec. 21, 2015 and European Patent Application No. 16152612.4, filed Jan. 25, 2016. These applications are hereby incorporated by reference herein.

FIELD OF THE INVENTION

The present invention relates to a heatsink comprising a rim having a first rim section, a second rim section and a plurality of first fins extending from a mounting region to at least one of the first rim section and the second rim section.

The present invention further relates to a luminaire comprising such a heatsink.

BACKGROUND OF THE INVENTION

Solid state lighting such as LED lighting is becoming increasingly popular because of the energy efficient nature of such lighting as well as the lifetime of such lighting. A further advantage of solid state lighting is that the solid state lighting devices may have a configurable luminous output with short response times to configuration changes. This has led to the advent of intelligent luminaires including solid state lighting devices that further include one or more sensors and/or controllers for configuring the luminous output of the solid state lighting devices, e.g. dimming level, colour temperature and/or colour point of the solid state lighting devices.

In order to ensure an extended lifetime and desired luminous output of the solid state lighting devices, the solid state lighting devices, e.g. LEDs, are typically mounted or otherwise thermally connected to a heatsink, which absorbs heat generated by the solid state lighting devices and transfers this heat to its surroundings. To this end, such a heatsink typically has a large surface area, often provided by a plurality of fins of a heat conductive material such as a metal, metal alloy or thermal plastic, in order to ensure a high rate of heat transfer between the heatsink and its surroundings. In this manner, the heatsink can effectively maintain the operating temperature of the solid state lighting devices below a critical temperature, at or above which the solid state lighting devices may exhibit a reduced lifetime and/or degradation of optical performance. An example of a solid state lighting device including a device-scaled stamped heatsink with a base portion and multiple segments or side-walls projecting outward from the base portion is disclosed in U.S. Pat. No. 8,362,509 B2.

Typically, the one or more sensors and/or controllers are also mounted on the heatsink, e.g. in a peripheral area of the heatsink. Consequently, the one or more sensors and/or controllers are subjected to the heat from the solid state lighting devices absorbed by the heatsink. This can cause problems, for example because the heat generated by the one or more sensors and/or controllers cannot be effectively dissipated by the heatsink due to a negligible temperature gradient between the one or more sensors and/or controllers and the heatsink or due to a heatsink having a higher temperature than the one or more sensors and/or controllers. This can cause overheating of the one or more sensors and/or controllers, which may lead to premature failure of such components. To avoid such problems, the one or more sensors and/or controllers may be mounted external to the heatsink, i.e. separate therefrom, but this typically leads to bulky and/or aesthetically unsatisfactory luminaires.

SUMMARY OF THE INVENTION

The present invention seeks to provide a luminaire including a heatsink that can provide effective cooling of one or more components additional to a light engine such as a solid state lighting device in thermal connection with the heatsink.

According to an aspect, there is provided a luminaire including a heatsink comprising a rim having a first rim section, a second rim section and an intermediate rim section in between the first rim section and the second rim section; a first heatsink region comprising a mounting region and a plurality of first fins extending from the mounting region to at least one of the first rim section and the second rim section; and a second heatsink region comprising a plurality of second fins looping from the intermediate rim section. On the heatsink, at least a portion of gaps allows air flowing therethrough at a direction from a first side of the mounting region and a second side of the mounting region opposite the first side, or vice versa, which gaps are delimited by the first fins, the second fins and/or the rim. In other words, such gaps can be formed between the first fins, between the second fins, between the first fins and the second fins, or between the fins and the rim. The convective air flow thus can effectively take away the heat generated during the luminaire operation. The heatsink of the present invention includes multiple heatsink domains that are thermally coupled via the rim only, such that these heatsink domains are largely thermally decoupled from each other. Consequently, by placing different components of a luminaire in different heatsink domains, the heatsink provides substantially independent cooling of these different components, thereby substantially reducing the risk that the heat generated by one component compromises the thermal performance of another component.

The heatsink preferably is planar to facilitate the mounting of various components on the heatsink.

The rim may further comprise a further intermediate rim section in between the first rim section and the second rim section opposite the intermediate rim section, the heatsink further comprising a third heatsink region comprising a plurality of third fins looping from the further intermediate rim section. This provides an additional substantially thermally insulated heat sink domain, thus facilitating the mounting of an additional component in the third heatsink region.

The heatsink preferably is planar to facilitate the mounting of various components on the heatsink.

The heatsink may be circular or oval in order to provide a heatsink with an aesthetically pleasing appearance.

The heatsink may be a metal or metal alloy heatsink to yield a heatsink with particularly favourable thermal characteristics.

The mounting region may be central to the heatsink to facilitate the mounting of one or more light engines in the centre of the heatsink. The mounting region may comprise a mounting plate, which has the advantage that a large mounting area is provided to which a component such as a light engine can be thermally coupled. Alternatively, the mounting region may comprise a mounting aperture, which has the advantage that a component may extend through the heatsink, e.g. to facilitate mating of different parts of the component on opposite sides of the heatsink.

In additional to the heatsink of any of the above embodiments, the luminaire further comprises a light module mounted in the mounting region and thermally coupled to the first heatsink region, the light module comprising at least one light engine and a controller for the at least one light engine; and a sensor mounted on the second heatsink region, the sensor being communicatively coupled to the controller, the controller being adapted to control the at least one light engine in response to a sensor signal from the sensor. Such a luminaire benefits from the sensor being thermally decoupled from the light module, thereby improving the lifetime of the sensor and the luminaire.

The at least one light engine preferably comprises a plurality of solid state lighting devices in order to provide a luminaire with particularly good lifetime and energy consumption characteristics. The plurality of solid state lighting devices may be adapted to produce a luminous output having a configurable spectral composition, wherein the controller is adapted to configure the spectral composition of said luminous output in response to said sensor signal. In this manner, the spectral composition, e.g. colour or white light colour temperature of the light produced by the solid state lighting elements may be matched to a particular environmental condition, e.g. ambient light. Alternatively or additionally, the controller may be adapted to control the intensity of the luminous output produced by the solid state lighting elements, e.g. to complement an ambient light level detected by the sensor.

The light module may comprise a housing including a light exit window on a first side of the mounting region and a cover mounted on a second side of the mounting region opposite the first side. The light exit window may comprise at least one beam shaping element, such as a diffusive element, a collimating element, a lens element and so on in order to shape the luminous output of the luminaire in a desired manner.

In an embodiment, the luminaire further comprises a counterbalancing arrangement attached to the cover, wherein the counterbalancing arrangement comprises a mounting pole vertically extending from the cover and having an end plate distal to the cover, the end plate having upwardly extending opposing end portions and a cylindrical body extending between the opposing end portions; and a sliding element slideably mounted on the cylindrical body for engaging with a ceiling hook, the sliding element comprising at least one fixing member for immobilizing the sliding element on the cylindrical body. Such an adjustable counterbalancing arrangement is capable of counteracting the off-centre centre of gravity of the luminaire caused by the positioning of a sensor in a peripheral region of the heatsink by adjusting the position of the sliding element on the cylindrical body. In this manner, the luminaire may be attached to a ceiling hook such that the luminaire assumes a level (horizontal) orientation, which for instance is desirable for aesthetic reasons.

The mounting pole may be rotatably mounted to the cover such that the luminaire may be rotated around the mounting pole. This is particularly advantageous for non-circular luminaires or luminaires having a non-circular light exit window, as such luminaires may be positioned in a desirable orientation by rotation of the luminaire around the mounting pole.

The sliding element may comprise opposing annular end portions and a recessed intermediate portion in between the opposing annular end portions, and wherein the at least one fixing member comprises a pair of screws, each screw mounted in a threaded cavity of one of the annular end portions, said threading cavity radially extending through the annular end portion to the cylindrical body. The recessed intermediate portion may be dimensions to receive the ceiling hook to facilitate attachment of the luminaire to a ceiling. The screws facilitate easy immobilisation of the sliding member on the cylindrical body by tightening the screws until the screws engage with the cylindrical body.

BRIEF DESCRIPTION OF THE DRAWINGS

Embodiments of the invention are described in more detail and by way of non-limiting examples with reference to the accompanying drawings, wherein.

DETAILED DESCRIPTION OF THE EMBODIMENTS

Figure 1:
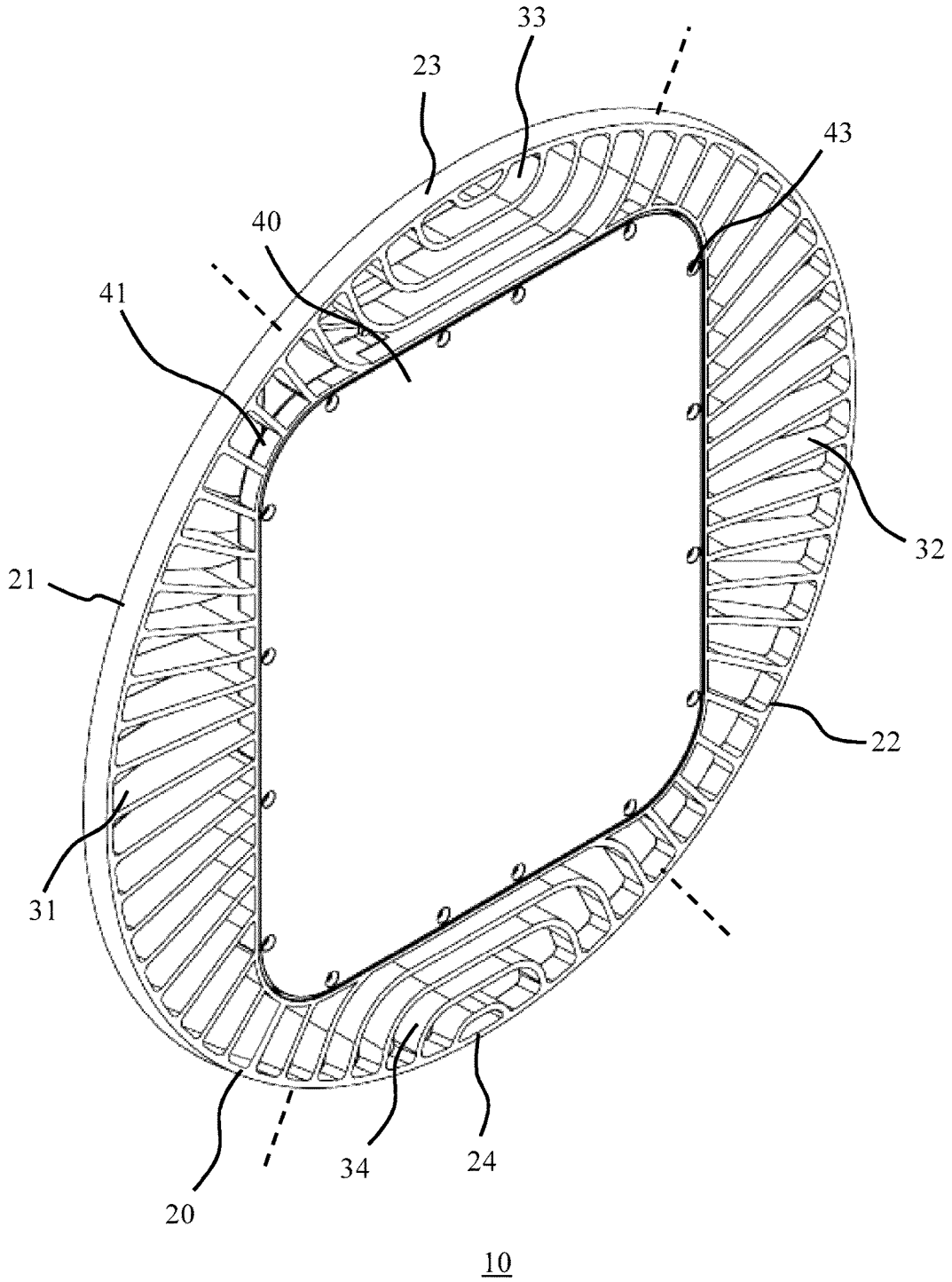
FIG. 1 schematically depicts a perspective view of a heatsink according to an embodiment.

It should be understood that the Figures are merely schematic and are not drawn to scale. It should also be understood that the same reference numerals are used throughout the Figures to indicate the same or similar parts.

FIG. 1 schematically depicts a perspective view of a heatsink 10 according to an embodiment. The heatsink 10 comprises a peripheral rim 20 surrounding a central mounting region 40 of the heatsink 10. The central mounting region 40 is here shown as a mounting plate delimited by an internal rim 41, which mounting plate may have a plurality of fixing members 43, here shown as threaded holes formed in the mounting plate by way of non-limiting example only, which fixing members 43 may be used to affix a component such as a light module to the mounting plate, e.g. using screws mating with the threaded holes. Alternatively, the mounting plate may be replaced by a central aperture delimited by the internal rim 41, in which case the internal rim 41 may include the fixing members 43. The peripheral rim 20 comprises a plurality of regions, the boundaries of which are indicated in FIG. 1 by the dashed lines extending from the peripheral rim 20.

The heatsink 10 typically comprises a plurality of fins that extend from the central mounting region 40, e.g. from the internal rim 41, to a section of the peripheral rim 20. In FIG. 1, the heatsink 10 comprises fins 31 extending from the central mounting region 40 to a first section 21 of the peripheral rim 20 and fins 32 extending from the central mounting region 40 to a second section 22 of the peripheral rim 20. In FIG. 1, the first section 21 is positioned opposite the second section 22. In an alternative embodiment (not shown), the heatsink 10 may comprise a plurality of fins that extend from the first section 21 to the second section 22 of the peripheral rim 20, in which case the mounting region 40 may be defined by a central section of the plurality of fins, i.e. a component to be fitted central to the heatsink 10 may be fitted directly onto the plurality of fins, e.g. using fixing means such as clips or the like.

The heatsink 10 further comprises a plurality of second fins 33 that loop from an intermediate section 23 of the peripheral rim 20 located in between the first section 21 and the second section 22 of the peripheral rim 20, i.e. that begin and terminate at the intermediate section 23. Consequently, the second fins 33 together with the intermediate section 23 define a closed loop portion of the heatsink 10 that is thermally decoupled from the heatsink portion defined by the central mounting region 40 and the fins 31, 32 extending from the central mounting region 40 to the peripheral rim sections 21, 22 apart from the modest (negligible) thermal coupling between the peripheral rim sections 21, 22 and the intermediate peripheral rim section 23. A further component mounted on the plurality of second fins 33 or on a further mounting region (not shown) incorporated within the closed loop heatsink region may thus be thermally managed independently from a component mounted in the mounting region 40, thereby protecting the further component from heat generated by the component and vice versa.

The heatsink 10 may comprise a plurality of such closed loop heatsink regions. For example, as shown in FIG. 1, the heatsink 10 further comprises a third heatsink region defined by plurality of third fins 34 that loop from a further intermediate section 24 of the peripheral rim 20 located in between the first section 21 and the second section 22 of the peripheral rim 20 and located opposite the intermediate rim section 23. In this manner, the heatsink 10 may carry multiple components in different heatsink regions that are thermally decoupled from each other, thus providing effective thermal management to each of these components. In order to provide such effective thermal management, the surface area of each heatsink region may be designed to meet the heat transfer requirements of the component to be fitted in that region, as is well-known per se. The surface area of a heatsink region may be controlled by the area of individual fins in that region, the number of fins in that region, and so on.

The heatsink 10 should be made of one or more materials having good thermal conductivity. Preferably, the heatsink 10 is made of one or more metals or metal alloys as such materials have excellent thermal conductivity characteristics. For example, the heatsink 10 may be made of aluminium or an aluminium alloy, which is a low-cost lightweight material having excellent thermal conductivity characteristics. It should however be understood that the heatsink and may be made of any suitable thermally conductive material, e.g. a thermally conductive plastic.

The peripheral rim 20 preferably is a continuous rim such as an oval or circular rim, thereby providing an oval or circular heatsink 10, which may be considered particularly aesthetically pleasing. However, it should be understood that alternative designs, e.g. a heatsink 10 having a polygonal rim 20, e.g. a peripheral rim 20 having N sides in which N is an integer of value 3, 4, 5, 6, 7, 8, 9, 10, 11, 12 and so on, are also feasible. The heatsink 10 preferably is a planar heatsink for aesthetic reasons as well as to facilitate ease of mounting of components onto the heatsink 10. However, it should be understood that alternative designs may be contemplated; for example, the heatsink 10 may comprise a planar central mounting region 40 in a first plane and the peripheral rim 20 in a second plane, wherein the fins 31, 32 are curved fins extending from the central mounting region 40 to the peripheral rim 20 in order to emulate a lampshade. The second fins 33 and third fins 34 may match the curvature of the fins 31, 32 to complement the aesthetic appearance of the emulated lampshade. Other suitable designs will be immediately apparent to the skilled person.

Figure 2:
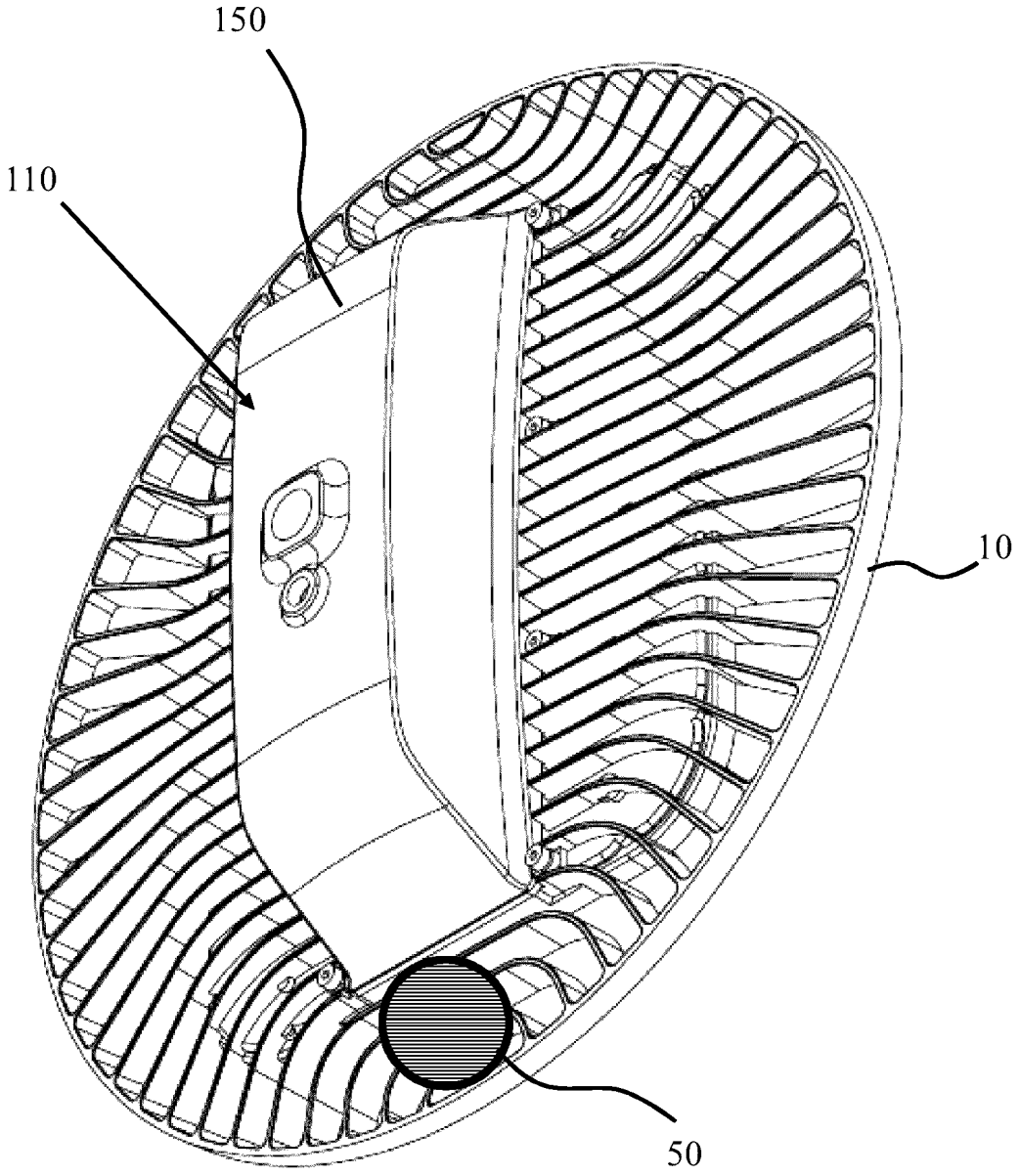
FIG. 2 schematically depicts a perspective view of a luminaire according to an embodiment.
Figure 3:
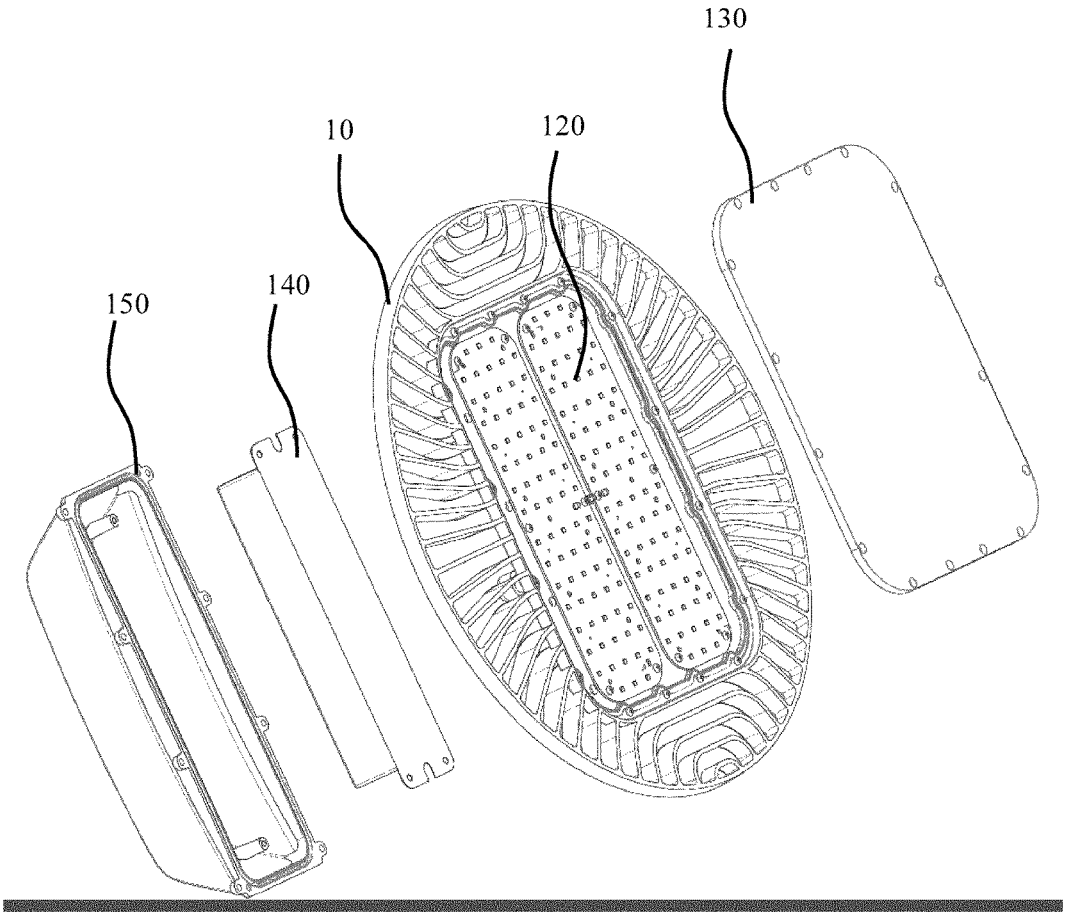
FIG. 3 schematically depicts an exploded view of a luminaire according to an embodiment.

FIG. 2 schematically depicts a perspective view and FIG. 3 schematically depicts an exploded view of a luminaire 100 including the heatsink 10 according to an embodiment. The luminaire 100 comprises a light module 110 mounted in the mounting region 40 and thermally coupled to the first heatsink region including the fins 31, 32 and the first rim section 21 and the second rim section 22 of the peripheral rim 20 as explained above. The light module 110 comprises at least one light engine 120, which at least one light engine preferably is at least one solid state lighting element such as at least one LED. The at least one light engine may be dimmable and/or may be able to produce an output having a configurable spectral composition, e.g. a white light output having a configurable colour temperature, e.g. a colour temperature ranging from about 2,000 to about 8,000 K, e.g. from about 2,500 K to about 6,500 K, and/or or a configurable coloured output having a spectral composition having a central spectral component ranging from 400 nm to 700 nm for example. Such a configurable luminous output may be achieved in any suitable manner and are for example by a light engine such as a solid-state lighting device being able to produce such a configurable output or by a plurality of individually controllable light engines such as a plurality of individually controllable solid state lighting devices producing outputs of different spectral compositions, wherein a selection of light engines may be engaged to produce an output of a desired spectral composition.

The light module 110 may further comprise a controller 140 including a driver for the at least one light engine, which controller 140 may be mounted on a major surface of the mounting region 40 opposing the major surface on which the at least one light engine 120 is mounted in case of the mounting region 40 comprising a mounting plate. The controller 140 may be protected by a cover 150 covering the controller 140. The controller 140 and the cover 150 may be mounted on the mounting region 40 in any suitable manner, e.g. using screws mating with threaded holes in the mounting region 40 as previously explained. Alternatively, the controller 140 may be mounted in the cover 150, with only the cover 150 being secured onto the mounting region 40. Many other suitable arrangements will be immediately apparent to the skilled person. The cover 150 may be made of any suitable material, preferably an electrically insulating material to protect a user from accidental electrocution. A suitable electrically insulating material for example is an electrically insulating plastic.

The light module 110 may further comprise a light exit window 130 fitted over the at least one light engine 120, e.g. over a plurality of solid state lighting devices. The light exit window 130 may prevent a user from directly contacting the at least one light engine 120, thereby protecting the user from accidental electrocution. To this end, the light exit window 130 may be made of an electrically insulating material such as glass or an electrically insulating optical grade polymer such as polycarbonate, polyethylene terephthalate, poly (methyl metacrylate) and so on. The light exit window 130 may further comprise at least one optical element to shape the luminous distribution produced by the at least one light engine 120. For example, the light exit window 130 may comprise one or more lenses, collimators or the like to shape the luminous distribution produced by the at least one light engine 120. In an embodiment, the light exit window 130 is a lens plate. The light exit window 130 may be transparent, translucent or diffuse. For example, the light exit window 130 may act as a diffuser of the luminous distribution produced by the at least one light engine 120. Such a diffuser may be implemented in any suitable manner, e.g. by a light exit window 130 having at least one roughened surface, a light exit window 130 comprising scattering elements, and so on. The light exit window 130 may be fitted onto the mounting region 40 of the heatsink 10 in any suitable manner, for example using screws mating with threaded holes as fixing members 43 in the central mounting region 40.

The luminaire 100 further comprises a sensor 50 mounted on the second heatsink region defined by the second fins 33 looping from the intermediate rim section 23. The sensor 50 is not particularly limited and may be any type of sensor that may be used in such a luminaire 100. For example the sensor 50 may be a light sensor adapted to measure a light intensity level or a spectral composition of ambient light. Alternatively, the sensor 50 may comprise a wireless communication module for receiving wireless instructions from a remote control unit such as a dedicated remote controller or a portable device such as a smart phone or tablet running a software application for controlling the luminaire 100. The sensor 150 is communicatively coupled to the controller 140, e.g. using one or more electrically conductive wires or using a wireless communication link. The controller 140 is typically adapted to control the at least one light engine 120 in response to a sensor signal from the sensor. For example, the controller 140 may be adapted to adjust at least one of a dimming level and the spectral composition of the luminous output of the at least one light engine 120, in response to such a sensor signal. Alternatively or additionally, the controller 140 may increase or decrease the number of light engines 120 being switched on in response to such a sensor signal. Other suitable sensor-controlled adjustments to the luminous output of the luminaire 100 will be immediately apparent to the skilled person.

Figure 4:
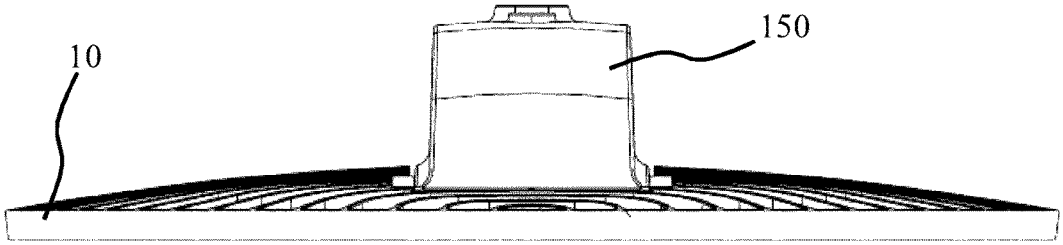
FIG. 4 schematically depicts a side view of a luminaire according to an embodiment.
Figure 5:
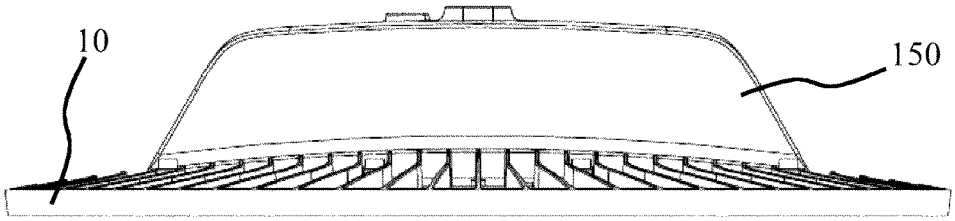
FIG. 5 schematically depicts another side view of a luminaire according to an embodiment.

In an embodiment, the cover 150 may have a substantially cuboid shape. FIG. 4 and FIG. 5 schematically depict respective side views of a luminaire 100 having such a cover 150 mounted on the heatsink 10. For such a luminaire 100, it may be desirable that the luminaire 100 can be mounted in a particular orientation such that an observer of the luminaire 100 is presented with a preferred (side) view of the luminaire 100, e.g. the view as schematically depicted in FIG. 4. How such an orientation may be controlled will be explained in more detail below.

Figure 6:
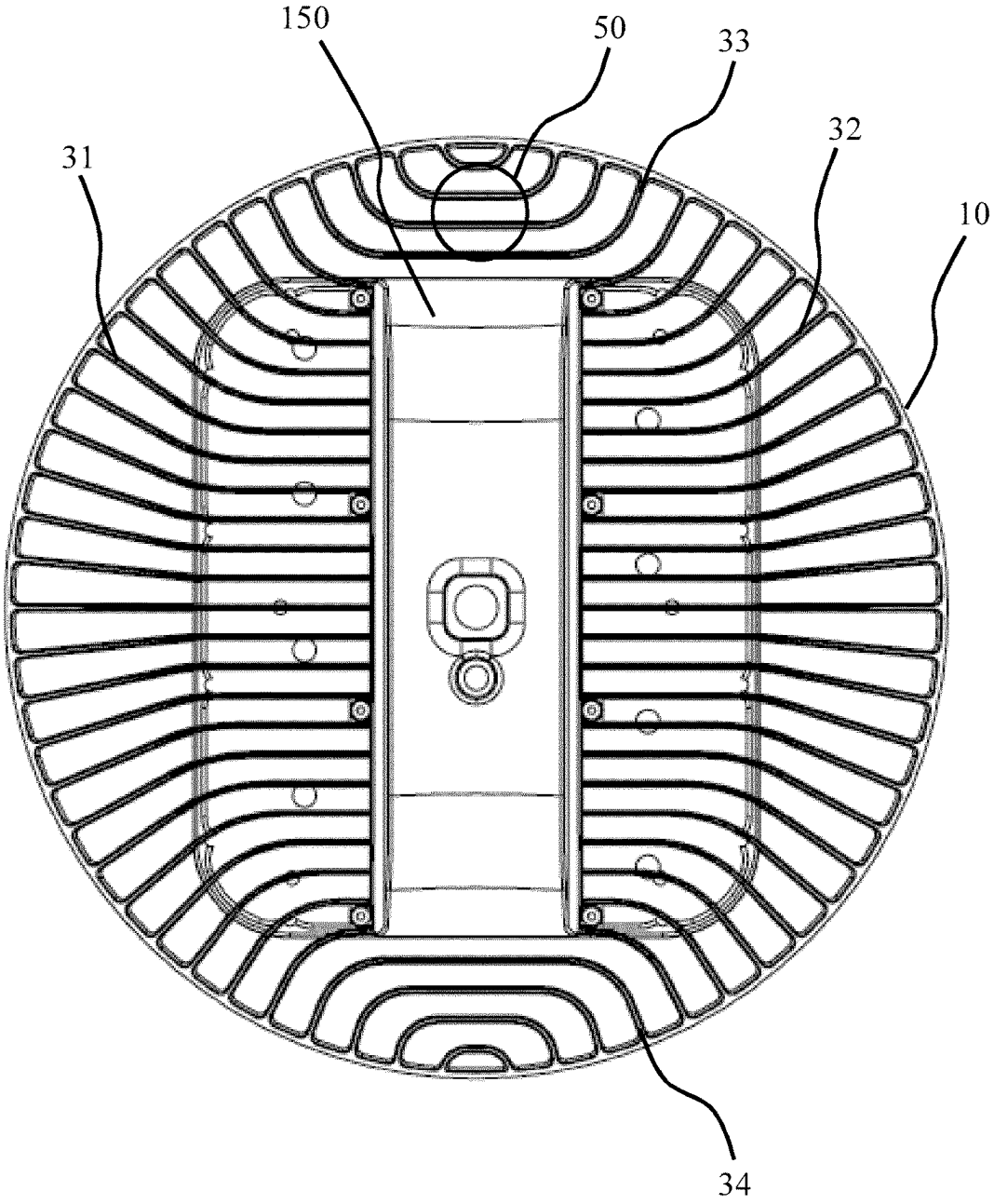
FIG. 6 schematically depicts a top view of a luminaire according to an embodiment.
Figure 7:
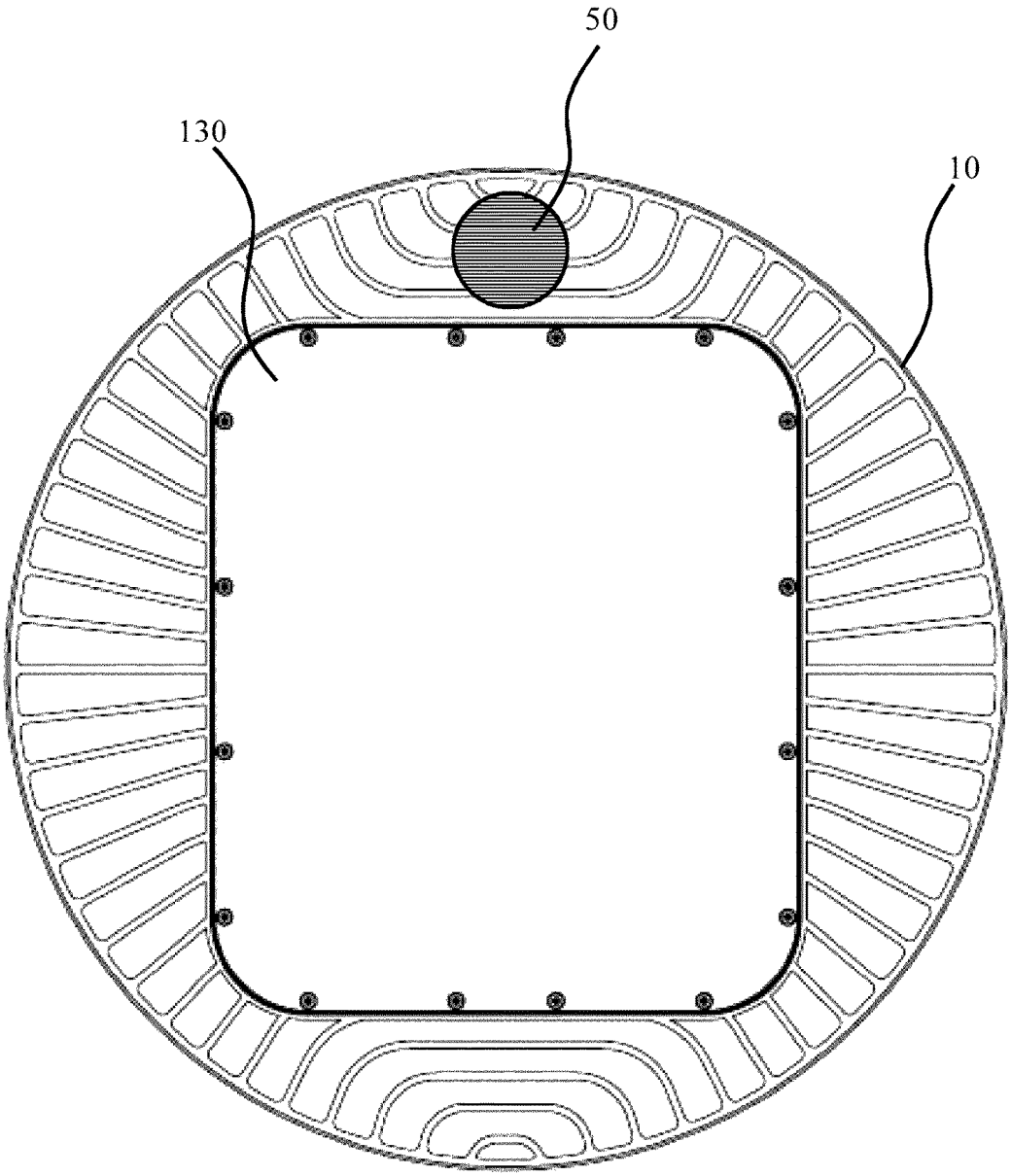
FIG. 7 schematically depicts a bottom view of a luminaire according to an embodiment.

FIG. 6 schematically depicts a top view and FIG. 7 schematically depicts a bottom view of such a luminaire 100. In this embodiment, the fins 31, 32 extend across at least a part of the mounting region 40 and may extend between the opposing rim sections 21, 22 of the peripheral rim 20 to which the fins 31, 32 are connected. In an embodiment, the heatsink 10 of the luminaire 100 comprises fins 31 that extend between the opposing rim sections 21, 22, i.e. these fins are not disrupted by the central mounting region 40. In FIG. 6, the cover 150 is mounted on a first (e.g. upper) major surface of the heatsink 10 and the sensor 50 is mounted on the opposing major surface of the heatsink 10, i.e. the lower major surface of the heatsink 10. It can be clearly recognised in FIG. 6 that the sensor 50 is mounted on the looping fins 33 of the second heatsink region. The third heatsink region including looping third fins 34 is unused in this embodiment and may be omitted in an alternative embodiment.

FIG. 7 schematically depicts the light exit window 130 and the sensor 50 on the same major surface of the heatsink 10. It should however be understood that this is by way of non-limiting examples only and that it is equally feasible that the sensor 50 is located in the second heatsink region on the same major surface as the cover 150, i.e. the major surface opposite the major surface carrying the light exit window 130.

Figure 8:
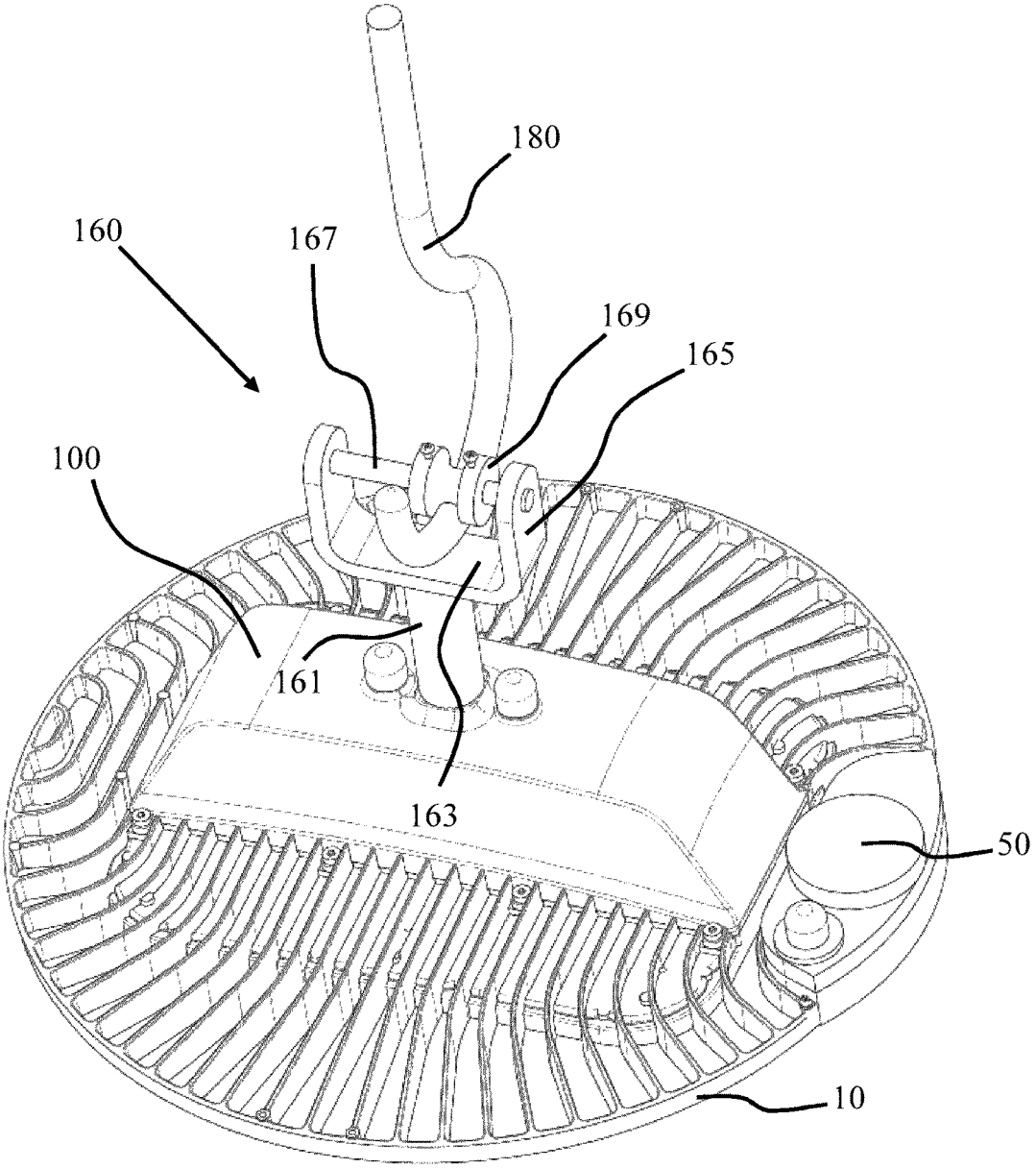
FIG. 8 schematically depicts a perspective view of a luminaire according to another embodiment.
Figure 9:
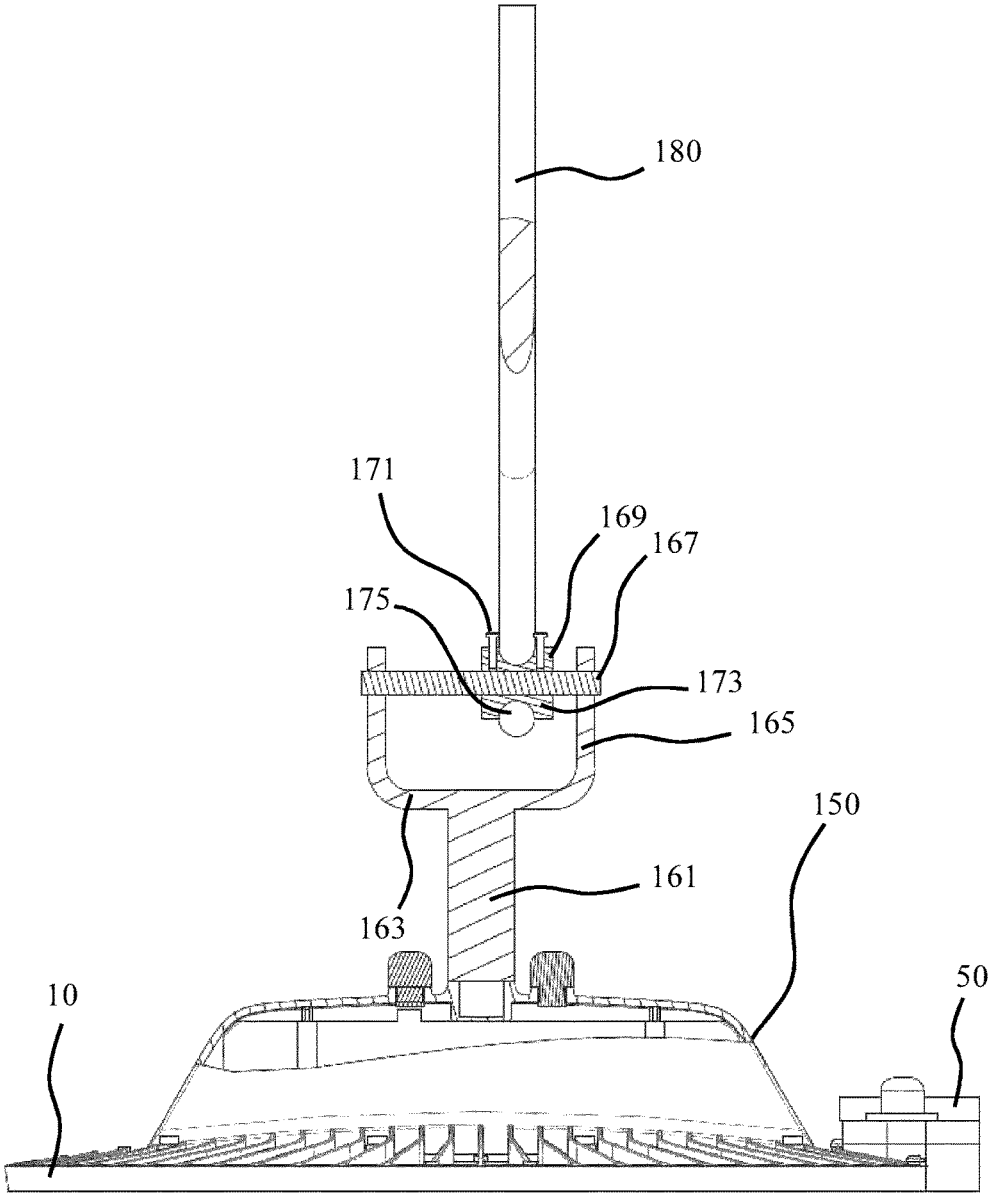
FIG. 9 schematically depicts a side view of a luminaire according to another embodiment.

FIG. 8 schematically depicts a perspective view and FIG. 9 schematically depicts a side view of a luminaire 100 according to another embodiment. In this embodiment, the luminaire 100 comprises a light module 110 including a cover 150 mounted in the central mounting region 40 of the heatsink 10 and further comprises a sensor 50 mounted in the second heatsink region as explained above. The presence of the sensor 50 causes the center of gravity of the luminaire 100 to be off-center. This would cause the heatsink 10 to assume a non-horizontal orientation when the luminaire 100 is attached in a central location to a hanging element such as a ceiling hook 180. Such a non-horizontal orientation usually is unacceptable from an aesthetic perspective.

In this embodiment, the luminaire 100 further comprises a counterbalancing arrangement for attaching the luminaire 100 to a hanging element such as a ceiling hook 180. The counterbalancing arrangement comprises a mounting pole 161 vertically extending from the cover 150. The mounting pole 161 may be connected to a central portion of the cover 150. In an embodiment, the mounting pole 161 is rotatably mounted to the cover 150 such that the luminaire 100 can be rotated around the mounting pole 161. This for example is advantageous if the cover 150 is a substantially cuboid cover, such that by rotating the luminaire 100 around the mounting pole 161, the luminaire 100 may be positioned in an aesthetically pleasing orientation for an observer of the luminaire 100.

The mounting pole 161 comprises an end plate 163 distal to the cover 150, i.e. the mounting pole 161 extends between the cover 150 and the end plate 163. The end plate 163 has upwardly extending opposing end portions 165, which preferably extend vertically from the end plate 163, such that the end plate 163 substantially has a U-shape.

The counterbalancing arrangement further comprises a cylindrical body 167 such as a cylindrical axis or the like, which cylindrical body 167 extends between the opposing end portions 165. A sliding element 169 is slideably mounted on the cylindrical body 167 for engaging with a hanging element such as a ceiling hook 180. The sliding element 169 comprises at least one fixing member 171 for immobilizing the sliding element on the cylindrical body 167. For example, the sliding element 169 may comprise one or more threaded cavities extending through the sliding element 169 having a threaded fixing member 171 such as a screw fitted in each threaded cavity such that the positioning of the threaded fixing member 171 can be adjusted by turning the threaded fixing member 171 until the threaded fixing member engages with the cylindrical body 167 and thereby immobilizes the sliding element 169 on the cylindrical body 167. In this manner, the sliding element 169 may be immobilized in an off-center position on the cylindrical body 167 to compensate for the non-centered center of gravity of the luminaire 100 such that when the sliding element 169 engages with a hanging element such as a ceiling hook 180, the heatsink 10 of the luminaire 100 assumes a desirable horizontal orientation.

The sliding element 169 typically is an annular body having a central hole dimensioned to snugly fit around the cylindrical body 167. In an embodiment, the sliding element 169 comprises opposing annular end portions 173 and a recessed intermediate portion 175 in between the opposing annular end portions for engaging with a hanging element such as a ceiling hook 180. For example, the recessed intermediate portion 175 may have a concavely curved surface profile matching the shape of a ceiling hook 180 having a circular cross-section. In this embodiment, the sliding element 169 may comprise a pair of screws in which each screw is mounted in a threaded cavity of one of the annular end portions 173, which threading cavity as before radially extends through the annular end portion 173 to the cylindrical body such that the sliding element 169 may be immobilized on the cylindrical body 167 by adjusting the position of the screws such that the screws engage with the cylindrical body 167.

Figure 10:
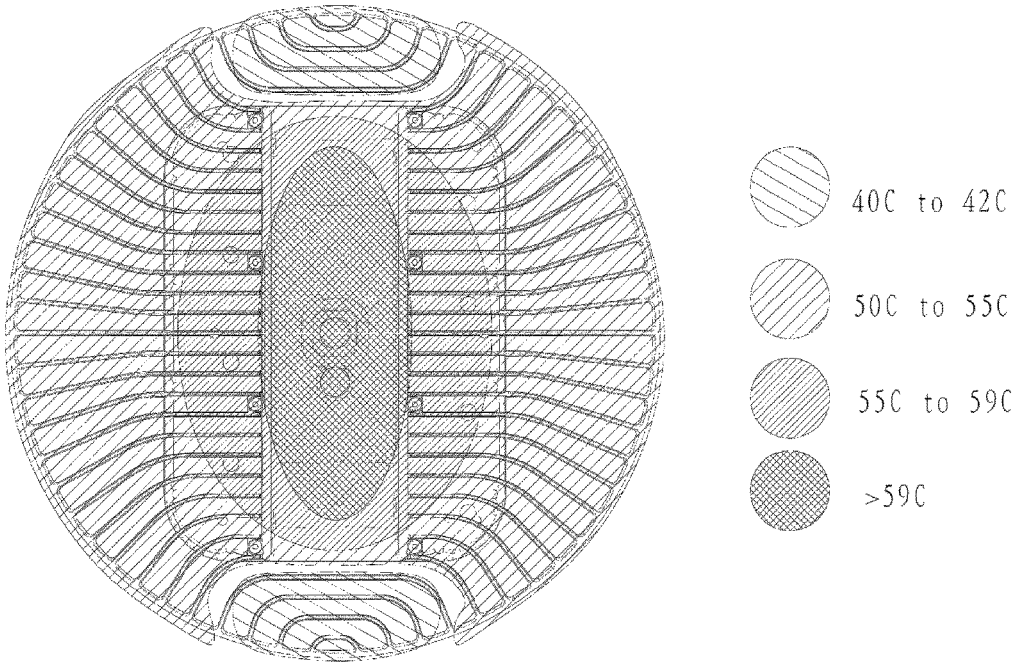
FIG. 10 is a simulation result of the thermal performance of a luminaire according to an embodiment.

FIG. 10 depicts a simulation result of the thermal performance of a luminaire 100 according to an embodiment of the present invention, in which a plurality of LEDs is mounted in the central mounting region 40. As can be seen from this simulation, the second and third heatsink regions defined by the fins looping from respective intermediate sections of the peripheral rim 20 of the heatsink 10 exit a substantially lower temperature (40-42° C.) compared the central mounting region 40 (at least 55° C.) and the first heatsink region including fins 31, 32 (50-55° C.). This simulation clearly demonstrates that the second and third heatsink regions are largely thermally decoupled from the first heatsink region dissipating the heat generated by the plurality of LEDs, such that this simulation clearly demonstrates that additional components, e.g. additional sensors, thermally coupled to the second or third heatsink regions are largely unaffected by the heat generated by the one or more light engines in the central region of the heatsink 10.

The luminaire 100 according to embodiments of the present invention has been described as a pendant or similar type of ceiling-mounted luminaire by way of non-limiting example only. The luminaire 100 may be any suitable type of luminaire, e.g. a flood light, a high or low bay light, a street lamp, a panel lamp, and so on.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A luminaire comprising:

a heatsink comprising:

a rim having a first rim section, a second rim section and an intermediate rim section in between the first rim section and the second rim section, a first heatsink region comprising a mounting region and a plurality of first fins extending from the mounting region to at least one of the first rim section and the second rim section, and a second heatsink region comprising a plurality of second fins looping from the intermediate rim section;

wherein at least a portion of gaps allows air flowing therethrough at a direction from a first side of the mounting region and a second side of the mounting region opposite the first side, or vice versa, which gaps are delimited by the first fins, the second fins and/or the rim;

a light module mounted in the mounting region and thermally coupled to the first heatsink region, the light module comprising at least one light engine and a controller for the at least one light engine; and a sensor mounted on the second heatsink region, the sensor being communicatively coupled to the controller, the controller being adapted to control the at least one light engine in response to a sensor signal from the sensor.

2. The luminaire of claim 1, wherein the heatsink is planar.

3. The luminaire of claim 1, the rim further comprising a further intermediate rim section in between the first rim section and the second rim section opposite the intermediate rim section, the heatsink further comprising a third heatsink region comprising a plurality of third fins looping from the further intermediate rim section.

4. The luminaire of claim 1, wherein the heatsink is circular or oval.

5. The luminaire of claim 1, wherein the heatsink is a metal or metal alloy heatsink.

6. The luminaire of claim 1, wherein the mounting region of the heatsink is central to the heatsink.

7. The luminaire of claim 1, wherein the mounting region of the heatsink comprises a mounting plate or a mounting aperture.

8. The luminaire of claim 1, wherein the at least one light engine comprises a plurality of solid state lighting devices.

9. The luminaire of claim 8, wherein the plurality of solid state lighting devices is adapted to produce a luminous output having a configurable spectral composition, wherein the controller is adapted to configure the spectral composition of said luminous output in response to said sensor signal.

10. The luminaire of claim 1, wherein the light module comprises a housing including a light exit window on the first side of the mounting region and a cover mounted on the second side of the mounting region opposite the first side.

11. The luminaire of claim 10, wherein the light exit window comprises at least one beam shaping element.

12. The luminaire of claim 10, further comprising a counterbalancing arrangement attached to the cover, wherein the counterbalancing arrangement comprises:

a mounting pole vertically extending from the cover and having an end plate distal to the cover, the end plate having upwardly extending opposing end portions and a cylindrical body extending between the opposing end portions; and a sliding element slideably mounted on the cylindrical body for engaging with a ceiling hook, the sliding element comprising at least one fixing member for immobilizing the sliding element on the cylindrical body.

13. The luminaire of claim 12, wherein the mounting pole is rotatably mounted to the cover.

14. The luminaire of claim 12, wherein the sliding element comprises opposing annular end portions and a recessed intermediate portion in between the opposing annular end portions, and wherein the at least one fixing member comprises a pair of screws, each screw mounted in a threaded cavity of one of the annular end portions, said threading cavity radially extending through the annular end portion to the cylindrical body.

* * * * *